US008047591B2

(12) United States Patent
Hwang

(10) Patent No.: US 8,047,591 B2
(45) Date of Patent: Nov. 1, 2011

(54) GRIP DEVICE FOR MOVING FRONT FLOOR

(75) Inventor: Doo Il Hwang, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 375 days.

(21) Appl. No.: 12/334,585

(22) Filed: Dec. 15, 2008

(65) Prior Publication Data

US 2009/0309379 A1 Dec. 17, 2009

(30) Foreign Application Priority Data

Jun. 11, 2008 (KR) ..... 10-2008-0054803

(51) Int. Cl.
*B66C 1/42* (2006.01)

(52) U.S. Cl. ..... 294/104; 294/115

(58) Field of Classification Search ..... 294/104, 294/88, 103.1, 115, 116; 901/30, 31, 36
See application file for complete search history.

(56) References Cited

U.S. PATENT DOCUMENTS

| | | | | |
|---|---|---|---|---|
| 4,621,854 | A * | 11/1986 | Boley et al. | 294/104 |
| 6,082,080 | A * | 7/2000 | Holter et al. | 294/81.52 |
| 6,733,224 | B1 * | 5/2004 | Linner | 414/416.02 |
| 2008/0277953 | A1 * | 11/2008 | Condliff | 294/104 |

FOREIGN PATENT DOCUMENTS

| | | |
|---|---|---|
| JP | 06-210580 | 8/1994 |
| JP | 06-335887 | 12/1994 |
| JP | 2005-279799 | 10/2005 |

* cited by examiner

*Primary Examiner* — Paul T Chin
(74) *Attorney, Agent, or Firm* — Edwards Angell Palmer & Dodge LLP; Peter F. Corless

(57) ABSTRACT

A grip device for moving a front floor of a vehicle includes a front clamping member and a rear clamping member. The front claming member can clamp a flange portion around a suspension mounting hole of the front floor according to an angle of the flange portion. The rear clamping member can claim a member flange portion of the front floor according to the change of clamping position. The device can be applied to various vehicle models.

7 Claims, 9 Drawing Sheets

GRIP DEVICE FOR MOVING FRONT FLOOR

CROSS-REFERENCE TO RELATED APPLICATION

This application claims priority to and the benefit of Korean Patent Application No. 10-2008-0054803 filed on Jun. 11, 2008, the entire contents of which are incorporated herein by reference.

BACKGROUND (a) Technical Field

The present invention relates to a grip device for moving a front floor of a vehicle, which can be applied regardless of a kind of vehicle.

(b) Background Art

In general, a grip device for moving a front floor is mounted to a robot in a vehicle body production line so as to grip and move a front floor of a vehicle from one production line to another production line or fix the front floor in a position for performing a sealer coating using a gun.

In a prior art grip device for moving a front floor, a flange portion around a suspension mounting hole of the front floor and a member flange portion are clamped by respective clampers.

The prior art grip device, however, has a drawback. In particular, as the size and cross-sectional shape of front floor parts, the angle and clamping spot of the flange portion around the suspension mounting hole, and the clamping spot of the member flange portion vary depending on types of vehicles, different grip devices have to be manufactured for different vehicle models, which increases overall manufacturing costs.

The above information disclosed in this Background section is only for enhancement of understanding of the background of the invention and therefore it may contain information that does not form the prior art that is already known in this country to a person of ordinary skill in the art.

SUMMARY

In one aspect, the present invention provides a grip device for moving a front floor that can be applied to various vehicle models, which includes: a grip frame comprising a front frame mounted at a front end of a robot arm and a rear frame integrally mounted at a rear end of the front frame and extending downwardly; a front clamping member mounted at each of both ends of the front frame through a front transverse moving member so as to hold a flange portion around a suspension mounting hole of the front floor; and a rear clamping member mounted at each of both ends of the rear frame through a rear transverse moving member and an upper/lower fixing member so as to clamp a member flange portion of the front floor.

Preferably, the front transverse moving member comprises: a front guide rail mounted at each of both sides of the lower surface of the front frame along a length direction thereof; a front slider slidably movable along the front guide rail so as to slide the front clamping member; and a front linear actuator mounted at each of both sides of the front surface of the front frame and provided with an operating rod connected to one side of a connecting bracket of the front clamping member.

Preferably, the front clamping member comprises: a cylinder housing connected to the front transverse moving member through the connecting bracket and provided with a piston integrally disposed to the piston rod therein; a link housing mounted at a lower portion of the cylinder housing, provided with a fixing pin therein and having a open bottom; a clamp arm disposed in the link housing, an upper end of which is hinged to a lower end of the piston rod and one side portion of which is provided with a bent slot to be engaged with the fixing pin; an upper self-aligning pad unit disposed to a lower end of the link housing, supported by resilient force of a spring, being able to move according to an angle of the flange portion around the suspension mounting hole of the front floor so as to clamp an upper surface thereof; and a lower self-aligning pad unit disposed to a lower end of the clamp arm so as to face the upper self-aligning pad unit, supported by resilient force of a spring, and being able to move corresponding to the angle of the flange portion around the suspension mounting hole so as to clamp a lower surface thereof.

Preferably, the upper self-aligning pad unit comprises: an engaging rod connected to a lower end of the link housing; a metal pad connected to the engaging rod by a ball and joint connection so as to be pivotably movable within a predetermined angle range; and a spring disposed between a lower end of the link housing and the metal pad so as to keep the metal pad horizontal.

Preferably, the lower self-aligning pad unit comprises: an engaging rod connected to a lower end of the clamp arm; a metal pad connected to the engaging rod by a ball and joint connection so as to be pivotally movable within a predetermined angle range; and a spring disposed between a lower end of the clamp arm and the metal pad so as to keep the metal pad horizontal.

Preferably, the rear transverse moving member comprises: a rear guide rail mounted at each of both sides of the lower surface of the rear frame along a length direction thereof; a rear slider slidably movable along the rear guide rail so as to slide the upper/lower fixing member; and a rear linear actuator mounted at each of both sides of the rear surface of the rear frame and provided with an operating rod connected to a mounting bracket of the upper/lower fixing member.

Preferably, the upper/lower fixing member comprises: a main bracket disposed at each of both sides of the front surface of the rear frame and connected to the rear transverse moving member through the mounting bracket; a linear brake disposed to an upper end of the main bracket such that a lower end of a brake shaft of the linear brake is connected to one end of the rear clamping member through a connecting block; and a return spring mounting on the brake shaft to provide a resilient force.

Preferably, the rear clamping member comprises: a locator secured to the upper/lower fixing member through a connecting block; a clamper hinged to a lower portion of the locator; and a clamping cylinder hinged to an upper portion of the locator, a front end of the operating rod of the clamping cylinder being hinged to a rear end of the clamper.

Preferably, the rear clamping member further comprises a sensor disposed to one end of the locator for detecting a member flange portion of a front floor and outputting a signal to a controller so as to control operation of the rear linear actuator.

The above-described devices can be applied to various vehicle models, decreasing manufacturing costs.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogenpowered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above and other features of the invention are discussed infra.

DETAILED DESCRIPTION

Exemplary embodiments of the present invention will hereinafter be described in detail with reference to the accompanying drawings.

Figure 1:
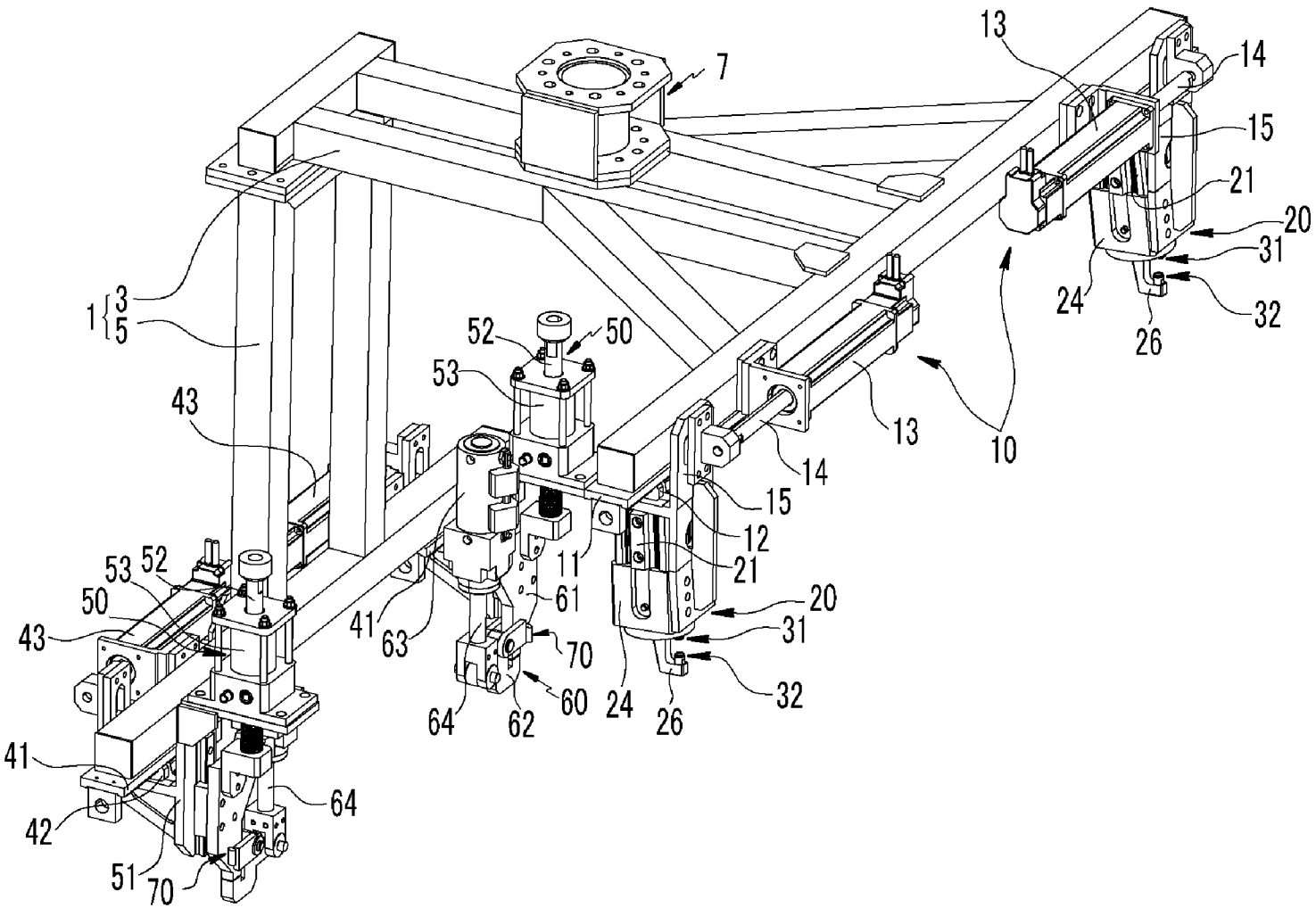
FIG. 1 is a perspective view showing a grip device for moving a front floor according to an exemplary embodiment of the present invention.
Figure 2:
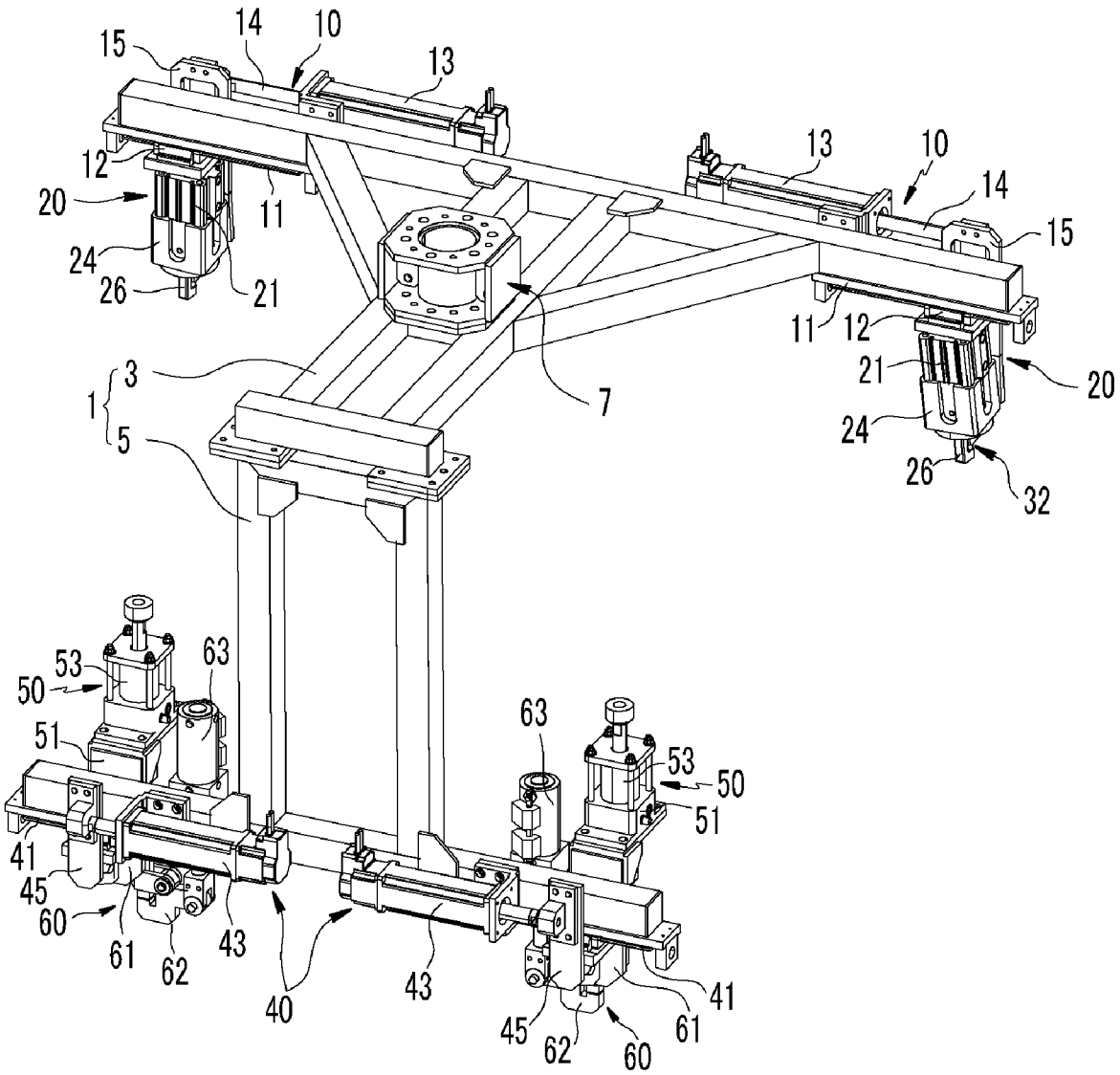
FIG. 2 is a rear view showing a grip device for moving a front floor according to an exemplary embodiment of the present invention.

FIG. 1 and FIG. 2 are front and rear perspective views of a grip device for moving a front floor according to an exemplary embodiment of the present invention.

Figure 3:
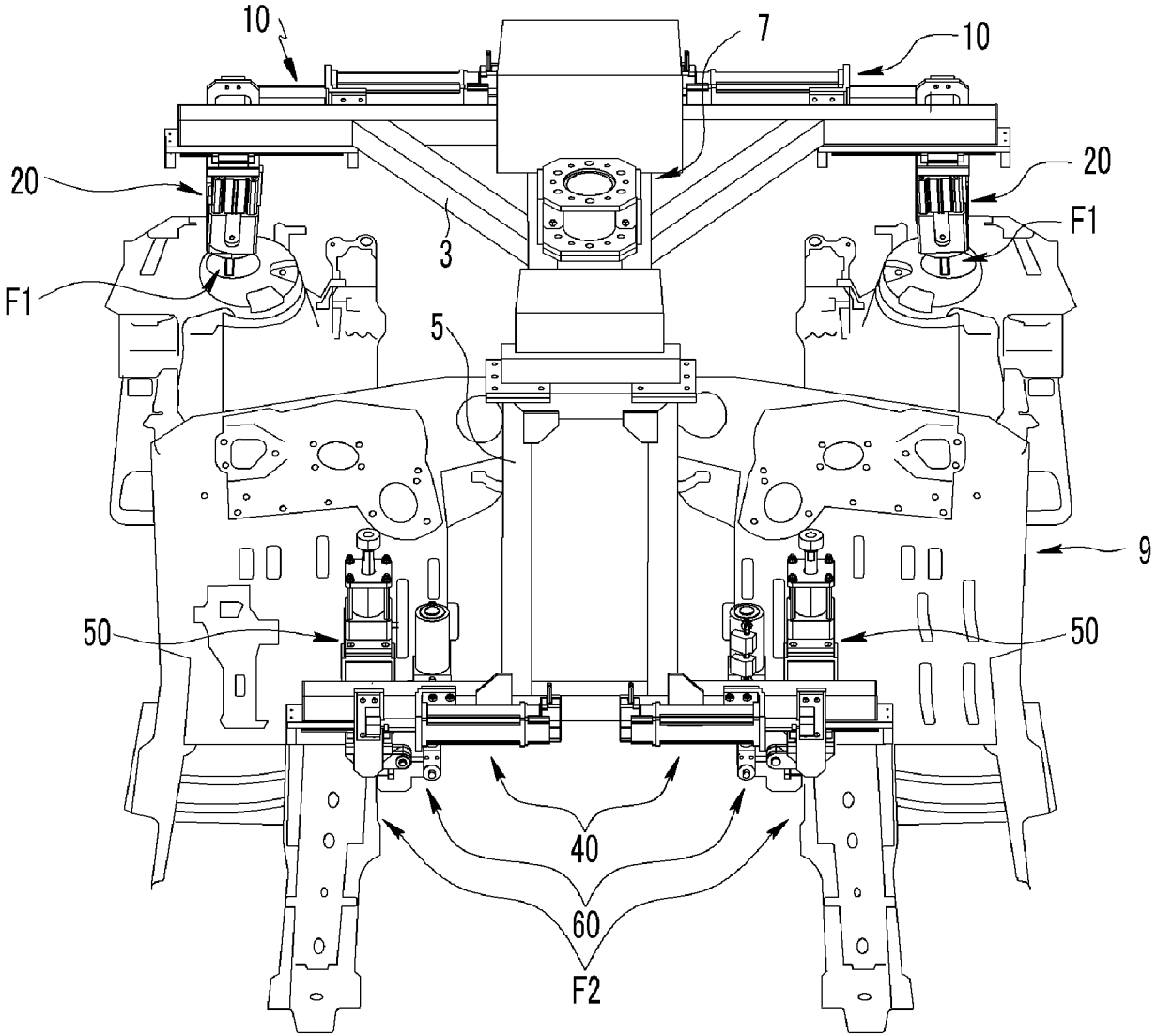
FIG. 3 shows an operating state of a grip device for moving a front floor according to an exemplary embodiment of the present invention.

FIG. 3 shows an operating state of the grip device for moving a front floor according to an exemplary embodiment of the present invention.

The grip device for moving a front floor according to an embodiment includes a grip frame 1 mounted to a front end of a robot arm (not shown).

The grip frame 1 includes a front frame 3 and a rear frame 5. The front frame 3 is mounted at one end of the robot arm through a mounting portion 7 in the middle thereof. The rear frame 5 is integrally combined to a rear end of the front frame 3 and extends downwardly.

A front clamping member 20 is mounted to each of both sides of the front frame 3 in a length direction through a front transverse moving member 10 so as to clamp a flange portion F1 around a suspension mounting hole of a front floor 9.

The front transverse moving member 10 includes a front guide rail 11, a front slider 12 and a front linear actuator 13.

Figure 4:
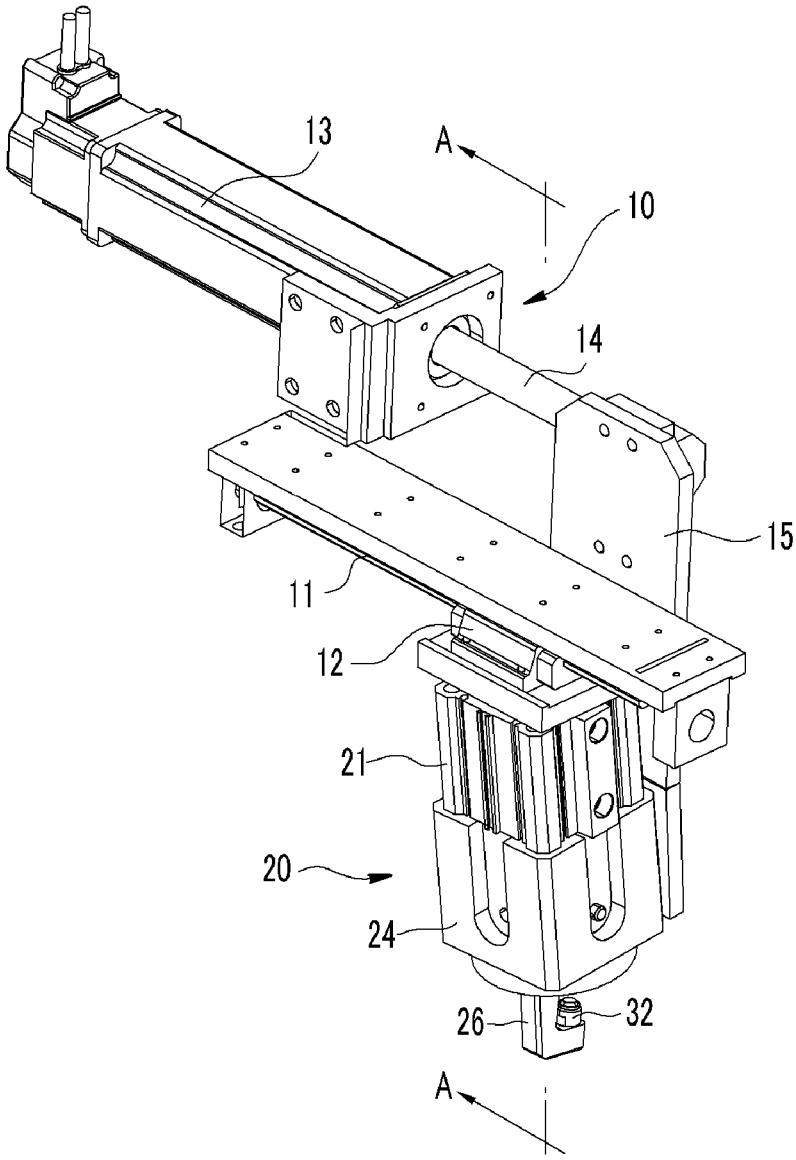
FIG. 4 is an enlarged perspective view showing a front clamping member adapted to a grip device for moving a front floor according to an exemplary embodiment of the present invention.

As shown in FIG. 4, the front guide rail 11 is provided at each of both sides of the lower surface of the front frame 3 along a length direction thereof.

A front slider 12 to which a front clamping member 20 is mounted is slidably mounted at each of the front guide rails 11.

The front linear actuator 13 is mounted at each of both sides of the front surface of the front frame 3. The front linear actuator 13 is provided with an operating rod 14 connected to one side of a connecting bracket 15 of the front clamping member 20 so as to provide a forward driving force and a rearward driving force.

In this case, the front linear actuator 13 may preferably be a step motor that is capable of accurately positioning by controlling a rotation angle and a rotation speed.

The front clamping member 20 includes a cylinder housing 21, a link housing 24, a clamp arm 26, an upper self-aligning pad unit 31 and a lower self-aligning pad unit 32.

Figure 5:
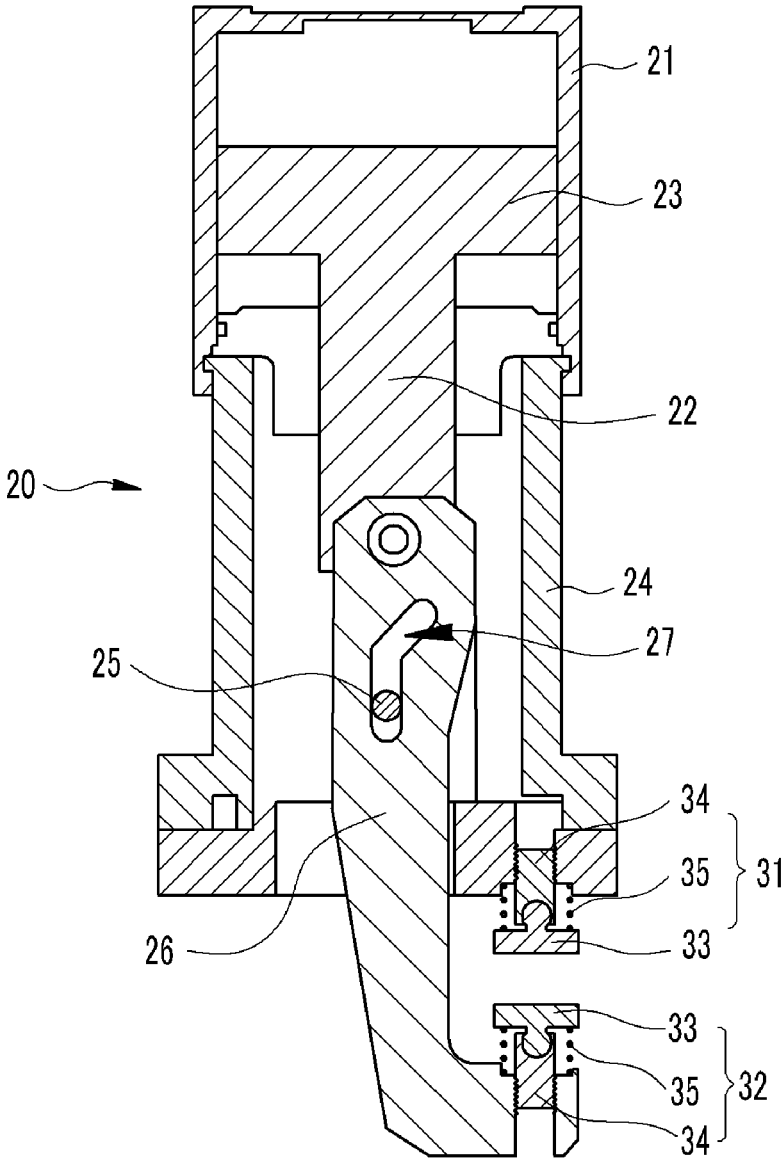
FIG. 5 is a cross-sectional view along line A-A of FIG. 4.

Specifically, as shown in FIG. 5, the cylinder housing 21 is connected to the connecting bracket 15 coupled to the operating rod 14 of the front linear actuator 13, and a piston 23 integrally formed with a piston rod 22 is disposed in the cylinder housing 21.

The link housing 24 that is open at its bottom is mounted at a lower portion of the cylinder housing 21, and a fixing pin 25 is disposed in one side of the link housing 24.

The clamp arm 26 is disposed in the link housing 24, an upper end of the clamp arm 26 is hinged to a lower end of the piston rod 22, and a bent slot 27 that is engaged with the fixing pin 25 is formed to one side of the clamp arm 26.

The upper self-aligning pad unit 31 is disposed to a lower end of the link housing 24.

The upper self-aligning pad unit 31 includes a metal pad 33, an engaging rod 34, and a spring 35. The engaging rod 34 is connected to a lower end of the link housing 24. The metal pad 33 is connected to the engaging rod 34 by a ball and joint connection so as to be pivotably movable within a predetermined angle range. The spring 35 is disposed between a lower end of the link housing 24 and the metal pad 33 so as to keep the metal pad 33 horizontal.

The upper self-aligning pad unit 31 is arranged such that it may be pivotable so as to clamp an upper surface of the front floor 9 according to an angle of the flange portion F1 relative to a virtual horizontal line while the metal pad 33 of the upper self-aligning pad unit 31 is supported by resilient force of the spring 35 thereof.

The lower self-aligning pad unit 32 is disposed to a lower end of the clamp arm 26 so as to face the upper self-aligning pad unit.

Likewise, the lower self-aligning pad unit 32 includes a metal pad 33, an engaging rod 34, and a spring 35. The engaging rod 34 is connected to a lower end of the clamp arm. The metal pad 33 is connected to the engaging rod 34 by a ball and joint connection so as to be pivotally movable within a predetermined angle range. The spring is disposed between a lower end of the clamp arm and the metal pad 33 so as to keep the metal pad horizontal.

The lower self-aligning pad unit 32 is arranged such that it may be pivotable so as to clamp a lower surface of the front floor 9 according to the angle of the flange portion while the metal pad 33 of the lower self-aligning pad unit 32 is supported by resilient force of the spring 35 thereof.

Meanwhile, a rear clamping member 60 is mounted at each of both sides of the rear frame 5 through a rear transverse moving member 40 and an upper/lower fixing member 50, and the rear clamping member 60 performs clamping of a member flange portion F2 of the front floor 9.

The rear transverse moving member includes a rear guide rail 41, a rear slider 42, and a rear linear actuator 43.

Figure 6:
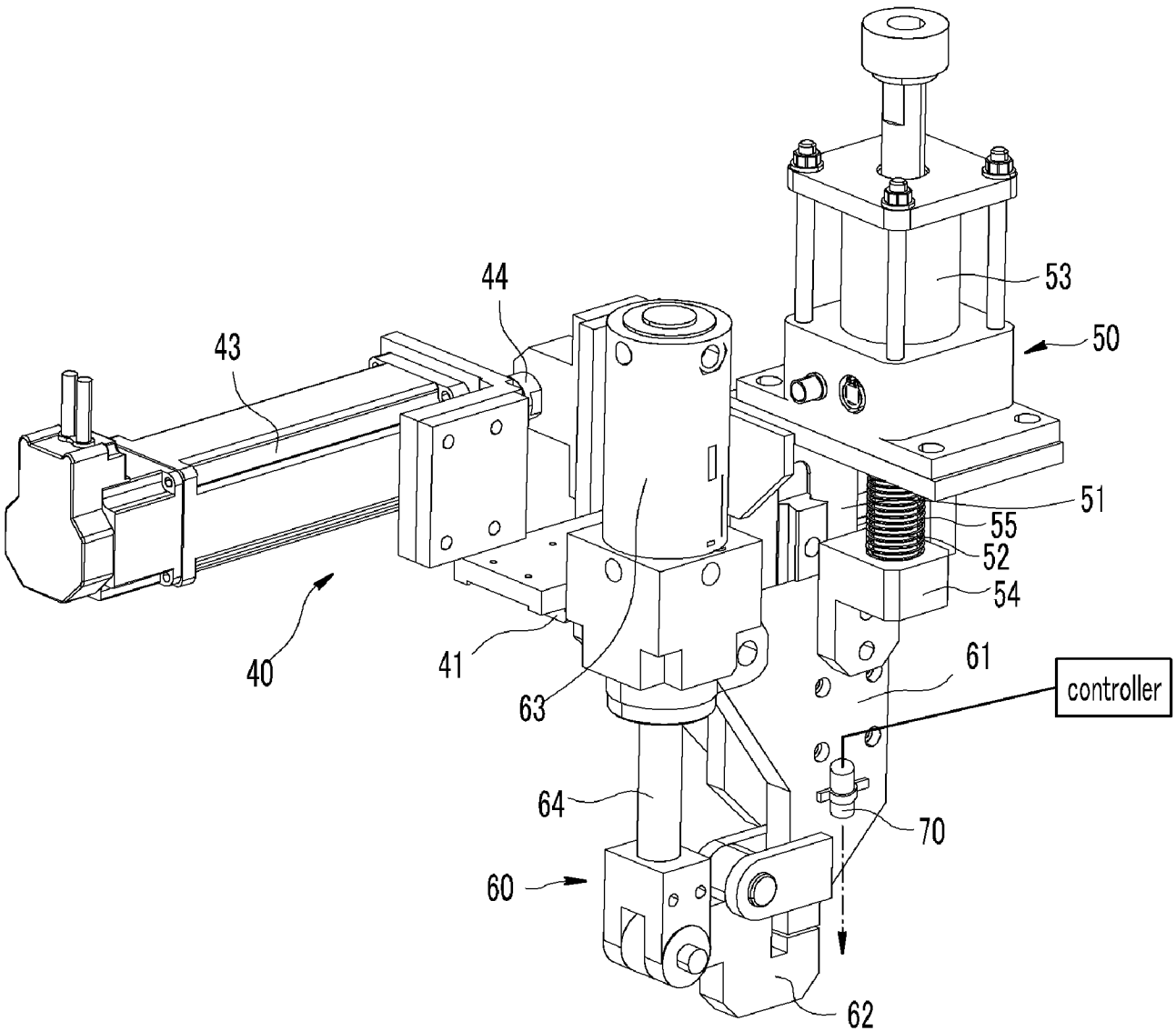
FIG. 6 is an enlarged front-side perspective view showing a rear clamping member adapted to a grip device for moving a front floor according to an exemplary embodiment of the present invention.
Figure 7:
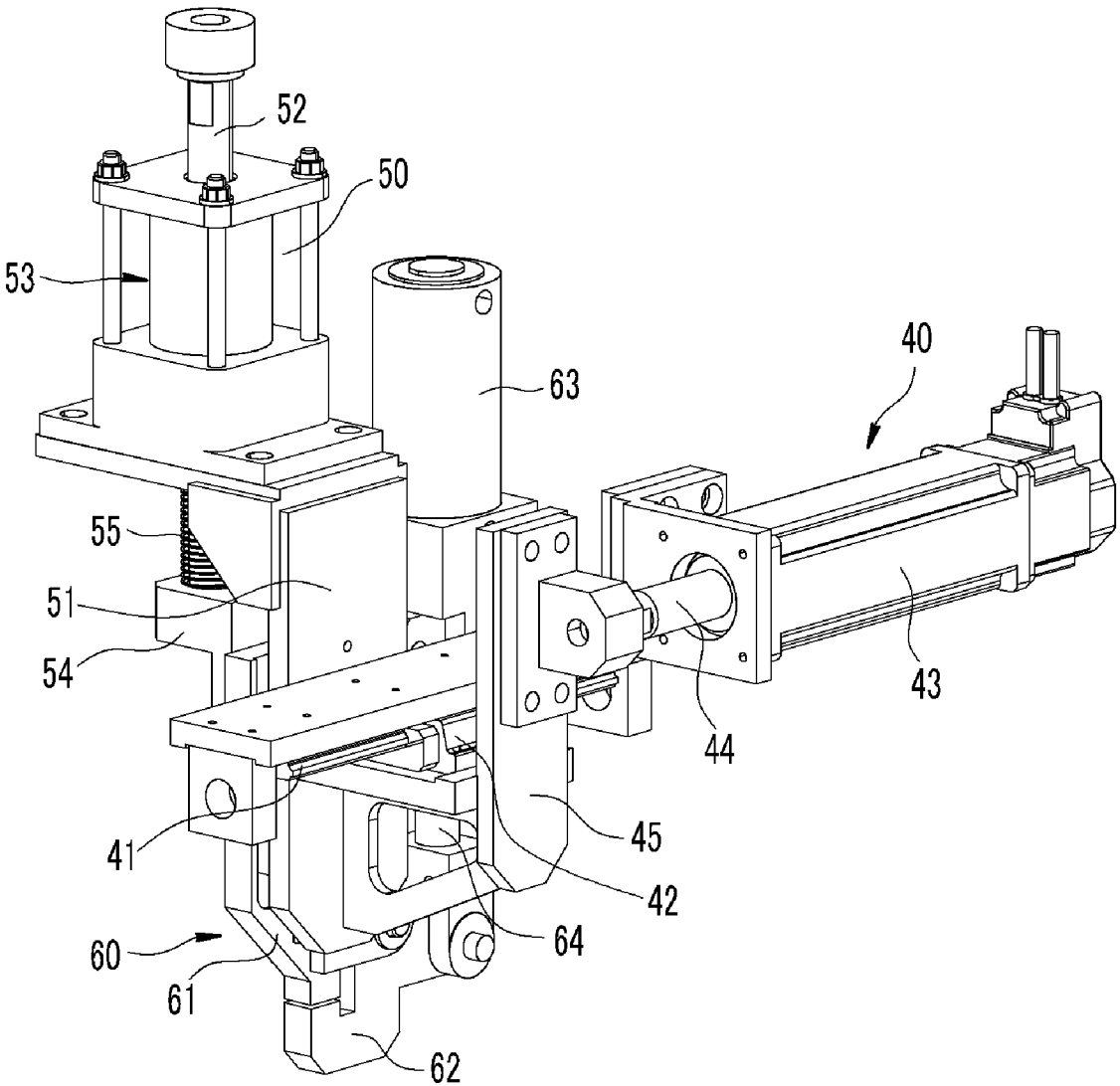
FIG. 7 is an enlarged rear-side perspective view showing a rear clamping member adapted to a grip device for moving a front floor according to an exemplary embodiment of the present invention.

As shown in FIG. 6 and FIG. 7, the rear guide rail 41 is mounted at each of both sides of the lower surface of the rear frame 5 along a length direction thereof.

The rear slider 42 to which the upper/lower fixing member 50 is mounted is slidably mounted along the rear guide rail 41.

The rear linear actuator 43 is mounted at each of both sides of the rear surface of the rear frame 5. The rear linear actuator 43 is provided with an operating rod 44 connected to the upper/lower fixing member 50 through a mounting bracket 45 of the upper/lower fixing member 50.

In this case, the rear linear actuator 43 may preferably be a step motor that is capable of accurately positioning by controlling a rotation angle and a rotation speed thereof.

The upper/lower fixing member 50 includes a main bracket 51, a linear brake 53, and a return spring 55.

The main bracket 51 is disposed at each of both sides of the front surface of the rear frame 5 and connected to the rear transverse moving member 40 through the mounting bracket 45.

The linear brake 53 is disposed to an upper end of the main bracket 51 such that a lower end of a brake shaft 52 of the linear brake 53 is connected to one end of the rear clamping member 60 through a connecting block 54.

The return spring 55 is mounted on the brake shaft 52 such that it provides a resilient force to the brake shaft 52. For example, a coil spring can be used as the return spring 55.

In addition, the rear clamping member 60 includes a locator 61, clamper 62, and a clamping cylinder 63. The locator 61 is secured to the brake shaft 52 through the connecting block 54. The clamper 62 is hinged to a lower end of the locator 61. The clamping cylinder 63 is hinged to an upper end of the locator 61. Further, one end of an operating rod 64 of the clamping cylinder 63 is hinged to a rear end of the clamper 62.

The rear clamping member 60 includes a sensor 70 mounted at one side of the locator 61, and the sensor 70 detects the member flange portion F2 of the front floor 9 and outputs a signal to a controller so as to control the operation of the rear linear actuator 43.

Figure 8:
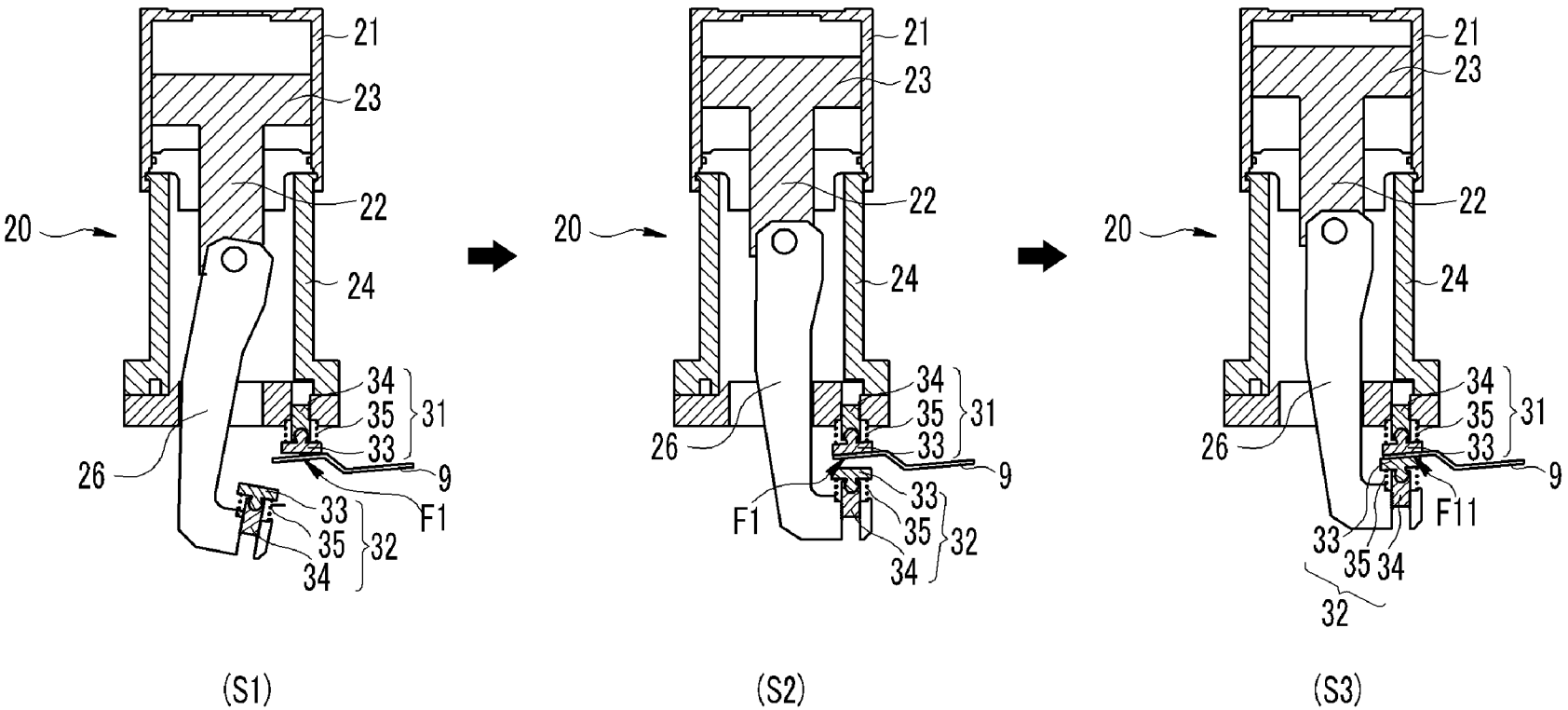
FIG. 8 shows operating modes of a front clamping member of a grip device for moving a front floor according to an exemplary embodiment of the present invention.
Figure 9:
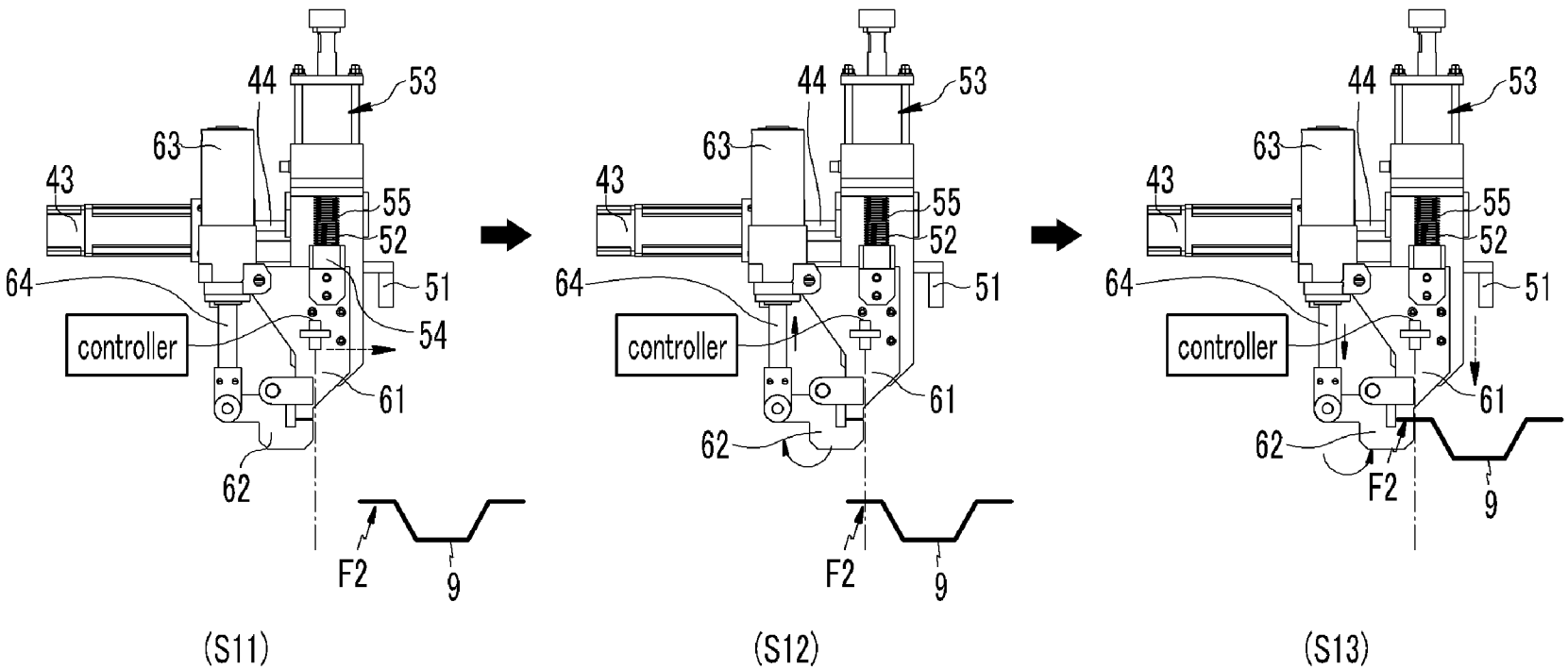
FIG. 9 shows operating modes of a rear clamping member of a grip device for moving a front floor according to an exemplary embodiment of the present invention.

Referring to FIG. 8 and FIG. 9, operation modes of the grip device for moving a front floor will be described in detail.

Firstly, the clamping member 20 is linearly moved to a position for clamping along the front guide rail 11 by an operation of the front linear actuator 13 so as to clamp a flange portion F1 around a suspension mounting hole of the front floor 9 according to a vehicle model.

Then, as shown in S1 of FIG. 8, the piston 23 inside the cylinder housing 21 is moved forwardly so that the clamp arm 26 is rotated with regard to the fixing pin 25 and opened.

In this state, as shown in S2 of FIG. 8, the metal pad 33 of the upper self-aligning pad unit 31 rotates according to the angle of the flange portion F1 around the suspension mounting hole of the front floor 9 and comes in close contact with the upper surface thereof.

Then, as shown in S3 of FIG. 8, when the piston 23 is moved rearwardly, the clamp arm 26 is rotated about the fixing pin 25 and closed.

At that time, the metal pad 33 of the lower self-aligning pad unit 32 is rotated according to the angle of the flange portion F1 around the suspension mounting hole of the front floor 9, and comes in close contact with the lower surface thereof.

Meanwhile, as shown in S11 of FIG. 9, the rear clamping member 60 is linearly moved to a position for clamping along the rear guide rail 41 by an operation of the rear linear actuator 43 so as to clamp a member flange portion F2 of the front floor 9 according to a vehicle model.

Then, as shown in S12 of FIG. 9, when the sensor 70 detects an edge portion of the front floor 9, it outputs an electrical signal to the controller, and thereafter the controller stops the operation of the linear actuator so as to stop horizontal moving of the clamping member 60 and the linear brake 53, thereby securely fixing them at their current positions.

At that time, when air pressure is applied to the linear brake 53, the brake shaft 52 is vertically moved downwardly by the return spring 55, and when the lower end of the locator 61 is in contact with the member flange portion F2 of the front floor 9, air pressure applied to the linear brake 53 is removed so as to secure fixing of the rear clamping member 60 at the current position.

In this state, the member flange portion F2 of the front floor 9 is clamped by an operation of the clamping cylinder 63 using the clamper 62 and the locator 61.

As described above, the grip devices according to the present invention can clamp the flange portion around the suspension mounting hole of the front floor according to the angle of the flange portion and can clamp the member flange portion according to the change of clamping position, which enables the grip devices to be applied to various vehicle models.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is;

1. A grip device for moving a front floor of a vehicle, comprising;

a grip frame comprising a front frame and a rear frame integrally mounted at a rear end of the front frame and extending downwardly;

a front clamping member mounted at each of both ends of the front frame through a front transverse moving member so as to hold a flange portion around a suspension mounting hole of the front floor;

a rear clamping member mounted at each of both ends of the rear frame through a rear transverse moving member and an upper or lower fixing member so as to clamp a member flange portion of the front floor;

a front guide rail mounted at each of both sides of the lower surface of the front frame along a length direction thereof;

a front slider slidably movable along the front guide rail so as to slide the front clamping member;

a front linear actuator mounted at each of both sides of the front surface of the front frame and provided with an operating rod connected to one side of a connecting bracket of the front clamping member;

a cylinder housing connected to the front transverse moving member through the connecting bracket and provided with a piston integrally disposed to the piston rod therein;

a link housing mounted at a lower portion of the cylinder housing, provided with a fixing pin therein and having an open bottom;

a clamp arm disposed in the link housing, an upper end of which is hinged to a lower end of the piston rod and one side portion of which is provided with a bent slot to be engaged with the fixing pin;

an upper self-aligning pad unit disposed to a lower end of the link housing, supported by resilient force of a spring, being able to move according to an angle of the flange portion around the suspension mounting hole of the front floor so as to clamp an upper surface thereof; and a lower self-aligning pad unit disposed to a lower end of the clamp arm so as to face the upper self-aligning pad unit, supported by resilient force of a spring, and being able to move corresponding to the angle of the flange portion around the suspension mounting hole so as to clamp a lower surface thereof.

2. The grip device for moving a front floor of claim 1, wherein the upper self-aligning pad unit comprises;

an engaging rod connected to a lower end of the link housing;

a metal pad connected to the engaging rod by a ball and joint connection so as to be pivotably movable within a predetermined angle range; and a spring disposed between a lower end of the link housing and the metal pad so as to keep the metal pad horizontal.

3. The grip device for moving a front floor of claim 1, wherein the lower self-aligning pad unit comprises;

an engaging rod connected to a lower end of the clamp arm;

a metal pad connected to the engaging rod by a ball and joint connection so as to be pivotally movable within a predetermined angle range; and a spring disposed between a lower end of the clamp arm and the metal pad so as to keep the metal pad horizontal.

4. The grip device for moving a front floor of claim 1, wherein the rear transverse moving member comprises;

a rear guide rail mounted at each of both sides of the lower surface of the rear frame along a length direction thereof;

a rear slider slidably movable along the rear guide rail so as to slide the upper/lower fixing member; and a rear linear actuator mounted at each of both sides of the rear surface of the rear frame and provided with an operating rod connected to a mounting bracket of the upper/lower fixing member.

5. The grip device for moving a front floor of claim 4, wherein the upper/lower fixing member comprises;

a main bracket disposed at each of both sides of the front surface of the rear frame and connected to the rear transverse moving member through the mounting bracket;

a linear brake disposed to an upper end of the main bracket such that a lower end of a brake shaft of the linear brake is connected to one end of the rear clamping member through a connecting block; and a return spring mounting on the brake shaft to provide a resilient force.

6. The grip device for moving a front floor of claim 4, wherein the rear clamping member comprises;

a locator secured to the upper/lower fixing member through a connecting block;

a clamper hinged to a lower portion of the locator; and a clamping cylinder hinged to an upper portion of the locator, a front end of the operating rod of the clamping cylinder being hinged to a rear end of the clamper.

7. The grip device for moving a front end of claim 6, wherein the rear clamping member further comprises a sensor disposed to one end of the locator for detecting a member flange portion of a front floor and outputting a signal to a controller so as to control operation of the rear linear actuator.

* * * * *